United States Patent [19]

Noll

[11] Patent Number: 4,741,147

[45] Date of Patent: May 3, 1988

[54] INSERTING APPARTUS AND PROCESS AND ENVELOPES THEREFOR

[76] Inventor: Marvin Noll, 208 Howard Ave., Passaic, N.J. 07055

[21] Appl. No.: 852,615

[22] Filed: Apr. 16, 1986

[51] Int. Cl.[4] ..... B65B 25/14; B65B 57/12

[52] U.S. Cl. ..... 53/505; 53/74; 53/117; 53/154; 53/206; 53/266 A

[58] Field of Search ..... 53/74, 117, 154, 206, 53/266 A, 505, 381 R; 271/263

[56] References Cited

U.S. PATENT DOCUMENTS

| | | | |
|---|---|---|---|
| 3,059,391 | 10/1962 | Volks | 53/266 A |
| 3,253,384 | 5/1966 | Huck | 53/117 X |
| 3,336,726 | 8/1967 | Mayer | 53/117 |
| 3,593,486 | 7/1971 | Helm | 53/206 X |
| 3,722,773 | 3/1973 | Plate | 271/263 X |
| 3,936,993 | 2/1976 | Dorer | 53/266 A |
| 4,003,183 | 1/1977 | Helm | 53/206 |
| 4,020,615 | 5/1977 | Irvine | 53/266 A |
| 4,106,766 | 8/1978 | Stefansson | 271/263 X |
| 4,159,611 | 7/1979 | Russell | 53/381 R |
| 4,202,150 | 5/1980 | Petersson | 53/206 |

*Primary Examiner*—John Sipos

*Attorney, Agent, or Firm*—Anthony J. Casella; Gerald E. Hespos

[57] ABSTRACT

An inserter is provided for use with one or more feeders. The inserter will receive material ejected from the first feeder, create at least one fold in the insert and then direct the insert into an awaiting envelope. The envelope is gradually opened as it is moved into position to receive the insert. A second insert may be urged into the first insert to initiate the fold in the first insert and urge the first insert into the envelope. The envelope preferably is provided with a pair of slits on one surface to facilitate the initial separation of the opposing surfaces thereof.

7 Claims, 4 Drawing Sheets

INSERTING APPARTUS AND PROCESS AND ENVELOPES THEREFOR

BACKGROUND OF THE INVENTION

Most business distribute a significant amount of material through either the United States Postal Service, private couriers or intraoffice distribution systems. The materials being distributed include, for example, written correspondence, invoices, payments, return postcards or envelopes, and laminated plastic identification cards or plastic credit cards. The material being distributed invariably is inserted into an envelope to insure confidentiality, to protect the item being shipped, to prevent the separation of several items or to conform with requirements of the carrier. The envelope may be printed with the address of the entity to which the material is being sent. Alternatively, the envelope may be provided with a window through which address indicia on the material being sent is displayed.

Many businesses distribute an extremely large volume of material, and thus are equipped with large, sophisticated and expensive equipment for use in this distribution process. However, many businesses distribute a volume of material that exceeds the practical limits for manual insertion into envelopes, but which does not reach a volume that would justify the substantial expenditure required to purchase one of the currently available inserters. For example, a business that distributes a few hundred pieces of mail each day almost certainly could not justify the large expenditure of money and the substantial allocation of office space for the available inserters. Typically, this smaller company would direct a few of their clerical employees to devote the last hour or two of each day to stuff envelopes with the invoices, laminated cards, or other material produced during the course of the day. This procedure, of course, is very labor intensive, requires employees to be periodically diverted from other more productive takes, and inherently includes a substantial probability of error. The most likely type of error in this manual insertion involves the improper collation of inserts with envelopes such that one addressee receives material intended for another.

Even if a small or medium size business invested the substantial sums to purchase an available inserter, the resulting product would have several significant disadvantages. The most obvious such disadvantage is the inflexibility of most such machines. More particularly, a machine adapted to insert invoices into envelopes could not readily be readapted periodically to distribute plastic identification cards or credit cards. Similarly, the known prior art machines could not conveniently switch from distributing some items with return envelopes and others without. The prior art machines also could not readily switch from folding the insert once to folding it several times. Furthermore, the typical prior art inserting apparatus has been substantially independent of other office equipment. Thus, an office that already had a printer, a plastic card embosser and/or an insert folder, could not readily enhance those existing machines with a functionally flexible inserter. If an inserter was purchased, it would not only be large and expensive, but also unable to be functionally integrated with the existing equipment. In most instances, the only choice available to the office manager would be the replacement of the existing equipment with a single, very costly and functionally inflexible piece of equipment to perform several functions.

An example of a typical inserting and distributing problem encountered in many companies involves the production and distribution of plastic identification or credit cards. These cards are widely distributed by stores, mail-order houses, employers, unions, schools and government agencies. Typically, the plastic cards and an explanatory letter to the cardowner are printed separately. These cards and letters then may be collated manually such that the card and the letter may be inserted in an envelope. The card may be adhesively fixed to the accompanying letter or may be incorporated into an array of retaining slots cut into the letter. In either case, this manual collation takes considerable time and presents the possibility of human error. Alternatively, the collation may be carried out mechanically by available equipment that applies adhesive to the cover letter and then secures the card to the adhesive. This equipment requires frequent cleaning to prevent clogging by excess adhesive. Additionally, the machine must be stopped periodically to insure that the plastic cards are being applied to the proper corresponding cover letter. This is especially important since the address on the cover letter often shows through a window on the envelope, and thus identifies the person who will receive the card. However, even with frequent stops for spot checking, there is a significant possibility that two offsetting collating errors will occur between spot checks, thereby providing certain people with incorrect credit or identification cards.

In view of the above, it is an object of the subject invention to provide an apparatus for inserting material into an envelope.

It is another object of the subject invention to provide an apparatus for collating materials to be inserted into an envelope.

It is an additional object of the subject invention to provide an apparatus for properly matching an identification or credit card to a proper cover letter.

It is a further object of the subject invention to provide an apparatus for securely enveloping a plastic card in a form addressed to the intended recipient of the card.

Another object of the subject invention is to provide a collating and inserting apparatus that can be readily adapted for use with existing office equipment.

Still another object of the subject invention is to provide a collating, folding and inserting apparatus that is small, lightweight and inexpensive.

An additional object of the subject invention is to provide a method for efficiently collating, folding and inserting materials into envelopes.

Still another object of the subject invention is to provide a form for securely enveloping a plastic card.

Yet another object of the subject invention is to provide an envelope for efficiently receiving materials to be inserted therein.

SUMMARY OF THE INVENTION

The subject invention is directed to a small, lightweight, versatile and inexpensive apparatus to be used with other office equipment for inserting materials into an envelope. In most embodiments, as explained further below, the subject apparatus and the related office equipment will be able to fit on an area no bigger than the standard desk top. Indeed, in many instances it is envisioned that the system into which the subject apparatus is incorporated will fit on an area substantially smaller than the standard desk top.

The apparatus of the subject invention comprises means for receiving sheets of material from a feeder of sheet material. The feeder may be part of a printing apparatus or computer which prints letters, forms or the like on sheets of paper. Alternatively, the feeder may merely be adapted to receive a plurality of previously printed sheets of material, and to sequentially feed these pre-printed sheets into the receiving means. The receiving means may comprise a pair of generally parallel and slightly spaced apart rollers which cooperate with one another.

The sheet of material may be guided by the receiving means toward a stop that may be adjustably located relative to the receiving means. On certain embodiments, this stop will be disposed to cause a controlled buckling of the insert sheet such that an area intermediate the opposed ends of the sheet will be urged into an inserting means, such as another pair of rollers at least one of which is driven. This inserting means will create a fold in the sheet of material. The relative location of the fold in the sheet of material can be precisely controlled by moving the stop relative to the receiving means and the inserting means.

The apparatus may be employed with a second feeder and a second receiving means. The second feeder may feed may feed a plastic card, a postcard, a return envelope or a second sheet of material. The second feeder may be part of a printing means, such as a means for printing, forming or embossing a plastic card. The second feeder preferably is operative to feed the insert into the second receiving means.

If both the first and second feeders are part of printing means, it is desirable to provide control means for insuring synchronous printing actions by the two units. In this situation, it is preferred that the slower printing means be the control to which the faster printing means is coordinated.

In embodiments of the invention which include both first and second receiving means, the second receiving means may be operative to urge the insert from the second feeder into the sheet from the first feeder. This contact between the insert and the sheet may be operative to urge the insert and the sheet of material into the second receiving means.

In embodiments of the subject invention wherein the insert is a plastic card, the sheet of material preferably will be a form adapted to securely engage the card. This form preferably will be dimensioned to have a single slightly off-center fold line, and the apparatus will be operative to fold the sheet along the fold line. The form preferably will include a pair of cut outs on the respective edges thereof opposite the fold. More particularly, the cut outs will lie at locations that will be in register and adjacent to the card being engaged by the sheet. These cut outs enable easy removal of the card from the sheet and also may provide a fail-safe check to insure that the card is properly mated with the sheet prior to insertion in the envelope. This check may be carried out by an appropriately located light source and a light sensor. If the card is properly enveloped, no light will be able to pass through the folded sheet. However, if the card is missing, light will pass through the location of the registered cut outs and will be sensed by the light sensor. The machine will then be stopped until the error is corrected. The apparatus may also include means for checking the thickness of the folded sheet and card enveloped therein. A thickness that is too great may signify two cards improperly being enveloped in the same sheet. This will also cause the apparatus to be stopped until proper collation is achieved. The sheet may be provided with appropriately located adhesive to securely engage the card therein. Alternatively the apparatus may include means for applying adhesive.

The apparatus may also be adapted to insert the materials into an envelope. More particularly, the apparatus will include an envelope feeder that intermittently feeds envelopes at a speed which reflects the speed of the inserter. The envelopes will be fed in an opened condition with the open side substantially adjacent and in line with the second receiving means. As each envelope is advanced into alignment with the second receiving means, it will move past stationary guide means which urge opposed faces to the envelopes slightly apart to facilitate the reception of the insert. To further facilitate this opening of the envelope, an envelope with a pair of slits adjacent or on its rear face is provided. These slits may be disposed to be covered by the flap of the envelope such that security of the materials to be inserted therein will not be compromised. After the slightly opened envelope is in proper alignment with the second receiving means, the envelope will be retained in a stationary position until the insert is disposed therein. The stopping and starting of the envelope immediately before and immediately after the insertion may be controlled by sensing means. For example, the envelope may be printed with a metallic ink. The sensed presence of the metallic ink will cause the envelope to stop in position to receive the insert. A properly inserted card and/or sheet of material may block the metallic ink thus causing the envelope and insert to move. The envelope and insert may be ejected and sent on their way to the addressee.

In certain embodiments, the above described apparatus may be incorporated for use with a postage meter which will properly stamp and seal the envelopes. In other embodiments, the envelope feeder may be part of a third printing means which prints the appropriate address indicia thereon. In this latter embodiment, the actions and relative speeds of each printer should be controlled by a common control means.

The apparatus preferably is provided with a means for detecting jams. This means comprises a pair of hinged plates disposed such that the hinge defines the above described stop. The sheet of material will advance between the two plates and into contact with the hinge. If for some reason too many sheets are advanced, one of the plates will rotate about the hinge and the spacing between the plates will increase. The apparatus will include switch means for detecting this movement and for signaling the jam.

The apparatus also may be adapted to create two folds in the sheet of material. In this embodiment, the first receiving means is adapted to initially direct the sheet of material toward a first adjustably located stop. The stop will cause the sheet to buckle into the nip between a pair of rollers which then direct the sheet toward a second stop. The sheet will then be urged into the second receiving means, as explained above, such that a second fold is formed in the sheet.

DETAILED DESCRIPTION OF THE PREFERRED EMBODIMENTS

Figure 1:
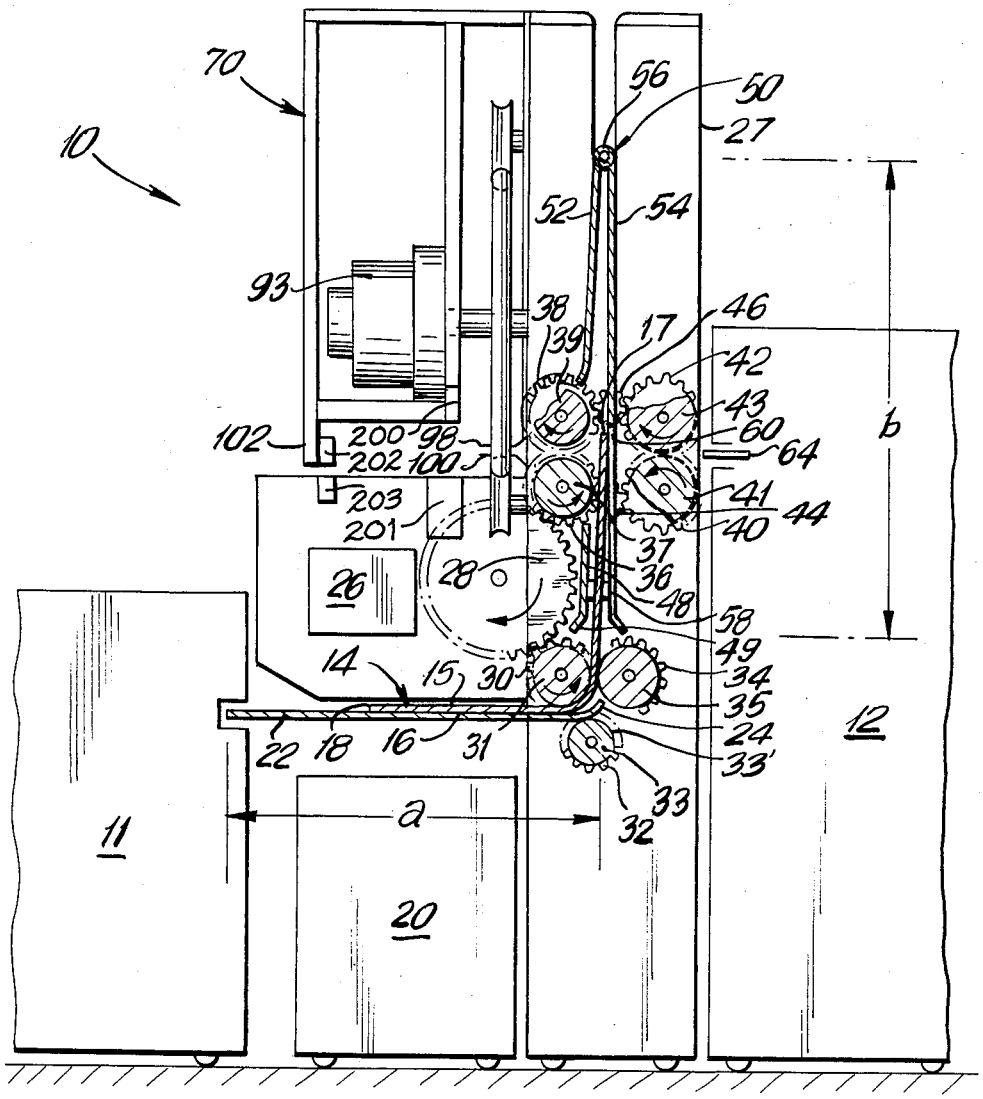
FIG. 1 is a side view of the inserting apparatus of the subject invention employed with two feeders.

A preferred embodiment of the inserter of the subject invention is illustrated in FIG. 1 and is identified generally by the numeral 10. The inserter 10 is adapted for use with a first feeder 11 and with a second feeder 12. The first feeder 11 is operative to sequentially feed sheets of material 14 to the inserter 10. Each sheet of material 14 typically will comprise a single piece of paper. However, a plurality of attached papers may comprise the sheet material 14, as may any other generally planar flexible non-paper material. Each sheet 14 includes opposed first and second surfaces 15 and 16 and opposed leading and trailing edges 17 and 18.

The first feeder 11 may merely be adapted to sequentially feed blank or previously printed sheets of material 14. Preferably, however, the first feeder 11 will be adapted to print selected material on each sheet 14 prior to feeding successive sheets 14 therefrom. More particularly, the first feeder 14 may include or be in communication with control means 20 which instructs the first feeder 11 as to the specific indicia to be printed on each sheet 14. Typically, each sheet 14 will be printed with unique information such as a name, address, identification number, and/or invoice material.

Figure 2:
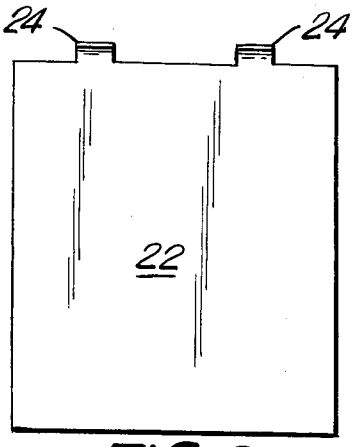
FIG. 2 is a top plan view of the insert support shown in FIG. 1.

Each sheet 14 is fed from the first feeder 11 toward the inserter 10. To insure proper alignment of the sheet 14 between the first feeder 11 and the inserter 10, a support 22 extends substantially the entire distance therebetween. The principal requirement of the support 22 is to provide a substantially rigid surface extending at a preferred angle and in a preferred direction to insure proper entry of each sheet 14 into the inserter 10. As depicted in FIGS. 1 and 2, however, the support 22 includes generally arcuate guides 24. The guides 24 cause each sheet of material 14 to move through the inserter 10 in such a way as to receive a single fold therein. In alternate embodiments, however, the support 22 and the guides 24 are configured to cause each sheet of material to receive two folds at selected locations thereon as each sheet moves through the inserter 10. This alternate embodiment will be illustrated and described further below.

The dimensions of support 22 will be determined by the dimensions of each sheet 14 and the dimensions of the envelopes into which sheets 14 are to be inserted. The dimension "a" of support 22 will always be less than the length of sheet 14. Typically, the support 22 will be dimensioned to leave a space "a" of approximately 4 inches between the first feeder 11 and the inserter 10.

The inserter 10 is provided with a first motor 26 which is mounted to the frame 27 and is operative to rotatably drive a primary gear 28. The primary gear 28 is operatively engaged with gear 30 which in turn is operatively engaged with gears 32 and 34. The gears 30, 32 and 34 are rotatably mounted to frame 27 and are fixedly mounted respectively to rollers 31, 33 and 35 respectively. The relative rotational movements of the gears 28, 30, 32 and 34 and the associated rollers 31, 33 and 35 are indicated by the arrows in FIG. 1. The roller 33 is provided with undercut portions 33' which are located and dimensioned to receive guides 24.

As explained previously, the first feeder 11 and the inserter 10 are spaced from one another by a distance "a" which is less than the length of each sheet 14, and which preferably is approximately 4 inches. As a result of these dimensions, each sheet 14 will be properly directed by the support 22 and guides 24 into the nip between rollers 31 and 33. The rollers 31 and 33 will continue to urge the sheet 14 in the desired direction even after the sheet 14 is completely separate from the first feeder 11. The rollers 31 and 33 are disposed such that the sheet will contact roller 31 first. These relative positions of rollers 31 and 33 assist guides 24 in effecting the directional change of sheet 14.

The guides 24 of support 22 will urge the sheet 14 through a substantially 90° change of direction such that the leading edge of the sheet 14 is engaged between and advanced by rollers 31 and 35. The sheet 14 then continues to to advance along a generally straight line for substantially its entire length.

The inserter 10 further includes gear 36 which is operatively engaged with the primary gear 28, and gear 38 which is operatively engaged with gear 36. Gears 36 and 38 are rotatably mounted to frame 27 and are fixedly mounted respectively to rollers 37 and 39. Preferably, the rotational axes of rollers 31, 37 and 39 are parallel and lie in a common plane and will be adjacent side 15 of sheet 14. Furthermore, the spacing between the rollers 31 and 37 is such that the intended location for a fold on sheet 14 will be approximately in line with the nip between rollers 37 and 39 when the sheet 14 is beginning to move out of the control of rollers 31 and 35.

The inserter 10 also is provided with feed rollers 41 and 43 which are mounted to gears 40 and 42 respectively and are driven by gears 44 and 46, which in turn are driven by gears 36 and 38. The feed rollers 41 and 43 define a nip which is substantially in line with the nip between rollers 37 and 39. However, the rollers 41 and 43 are disposed to be aligned adjacent side 16 of the sheet 14.

The sheet 14 is prevented from diverging from its intended path by panel 48 which is fixedly mounted to the frame 27. The panel 48 is generally in line with the roller 31 and includes a flange 49 disposed at an angle to the intended direction of movement of the sheet 14. The flange 49 ensures that sheet 14 advances along the proper side of the panel 48.

Figure 3:
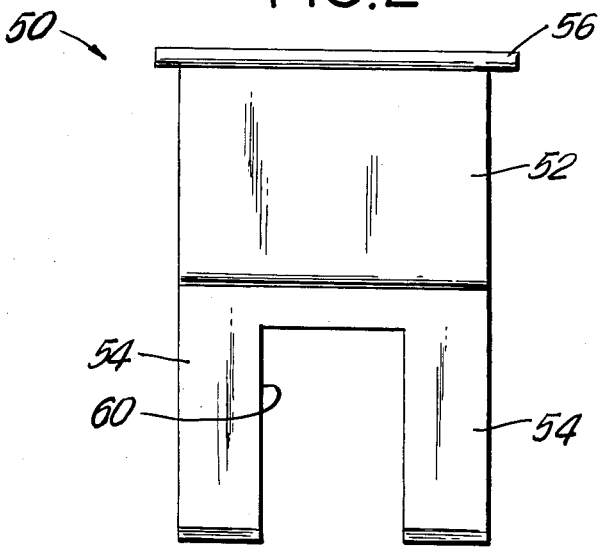
FIG. 3 is a front elevational view of the hinged guide assembly shown in FIG. 1.

The apparatus 10 also includes a hinged guide assembly 50, as shown in FIGS. 1 and 3, which cooperates with the panel 48 to guide the sheet 14. The hinged guide assembly 50 comprises a stationary guide plate 52 and a rotating guide plate 54 which are articulated to one another at hinge 56. The stationary guide plate 52 and the hinge 56 can be slidably inserted into the frame 27 such that the stationary guide plate 52 can not rotate relative to the frame 27. When inserted into the frame 27, the stationary guide plate 52 is generally aligned with the panel 48 and spaced therefrom.

The rotating guide plate 54 is free to rotate about hinge 56 and away from the stationary guide plate 52. The rotating guide plate 54 is maintained slightly spaced from the panel 48 by switch 58 a distance sufficient to positively guide sheet 14. The switch 58 is operative to generate a signal if the rotating guide plate 54 is separated therefrom by a jam, a multiple feed or other such malfunction. The signal also could be operative to completely stop inserter 10.

The rotating guide plate 54 includes a flange 55 which is angled opposite the flange 49 such that each sheet 14 is assured of advancing between the panel 48 and the rotating guide plate 54. As shown in FIG. 1, the rotating guide plate 40 has a length "b" about as long as the combined lengths of the panel 48 and the stationary guide plate 52.

As shown in FIGS. 1 and 3, the rotating guide plate 54 also is provided with a cut out 60 which is generally aligned with the nip between feed rollers 41 and 43, and with the space between the stationary guide plate 52 and the stationary panel 48. The cut out 60 has a length "c" sufficient to receive a card or similar item from the second feeder 12.

The inserter 10 further includes applicators 62 which are in line with the cut out 60. The applicators 62 are spaced apart a distance greater than the width of a card to be fed by the second feeder 12. The applicators 62 are operative to dispense a liquid onto surface 16 of sheet 14. The liquid may be adhesive or a wetting agent to activate an adhesive previously applied to sheet 14. The applicators 62 may also be operatively connected to gear 34 or 40 such that the applicators 62 move into an operative position only when a sheet 14 is present.

The second feeder 12 is operative to sequentially feed cards 64 or similar items that will be inserted into an envelope along with an associated sheet 14. More particularly, the second feeder 12 is operative to feed card 64 toward sheet 14 at a location in line with the nip between feed rollers 41 and 43. The cards 64 fed by the second feeder 12 may be credit cards, identification cards, return postcards or envelopes. The second feeder preferably is adapted to print selected indicia on the card 64. For example, the indicia printed on card 64 by the second feeder 12 may be identical to or compatible with the selected and unique information printed on the sheet 14 by the first feeder 11. For example, the second feeder may print or emboss the name and identification number of an individual on a credit card or identification card 64. The first feeder 11 may print the same name on sheet 14 along with an associated address and appropriate explanatory material for the individual named on both sheet 14 and the card 64. In the preferred embodiment both the first feeder 11 and the second feeder 12 will be controlled by a common control means 20. The control means 20 will not only provide the required information to both the first feeder 11 and the second feeder 12, but will also insure coordinated and preferably substantially simultaneous printing by both the first and second feeders 11 and 12. As will be explained herein, the preferred dimensions enable the substantially simultaneous printing by feeders 11 and 12 to eliminate any possible collating mistakes.

The operation of the first and second feeders 11 and 12 is coordinated by the controller 20 such that the card 64 produced by the second feeder 12 is ejected therefrom when the sheet 14 has passed substantially entirely through the rollers 31 and 35. When the sheet 14 is leaving rollers 31 and 35, the preferred location for the fold in the sheet 14 will be substantially in line with the nip between rollers 37 and 39. The card 64 ejected from the second feeder 12 will then be carried by feed rollers 41 and 43 into the sheet 14. More particularly, the card 64 will be urged into contact with sheet 14 substantially at its intended fold which may be at or near its midpoint. Thus, card 64 will urge sheet 14 into the nip between rollers 37 and 39. The sheet 14 thus will be folded around and envelop the card 64, and the adhesive applied or activated by applicators 62 will ensure that the card is positively engaged in an enclosure on sheet 14. To place this aspect of the operation in context, it should be restated that card 64 may be a credit card or identification card produced by the second feeder 12 and assigned to a particular individual. The sheet 14, on the other hand, may be a letter or information sheet uniquely adapted to match a credit card or other such card 64 produced by the second feeder 12. The system described thus far will produce a perfectly matched pair. In other applications, the sheet 14 may be an invoice, advertisement or the like, while the card 64 may be a return envelope or postcard.

Figure 4:
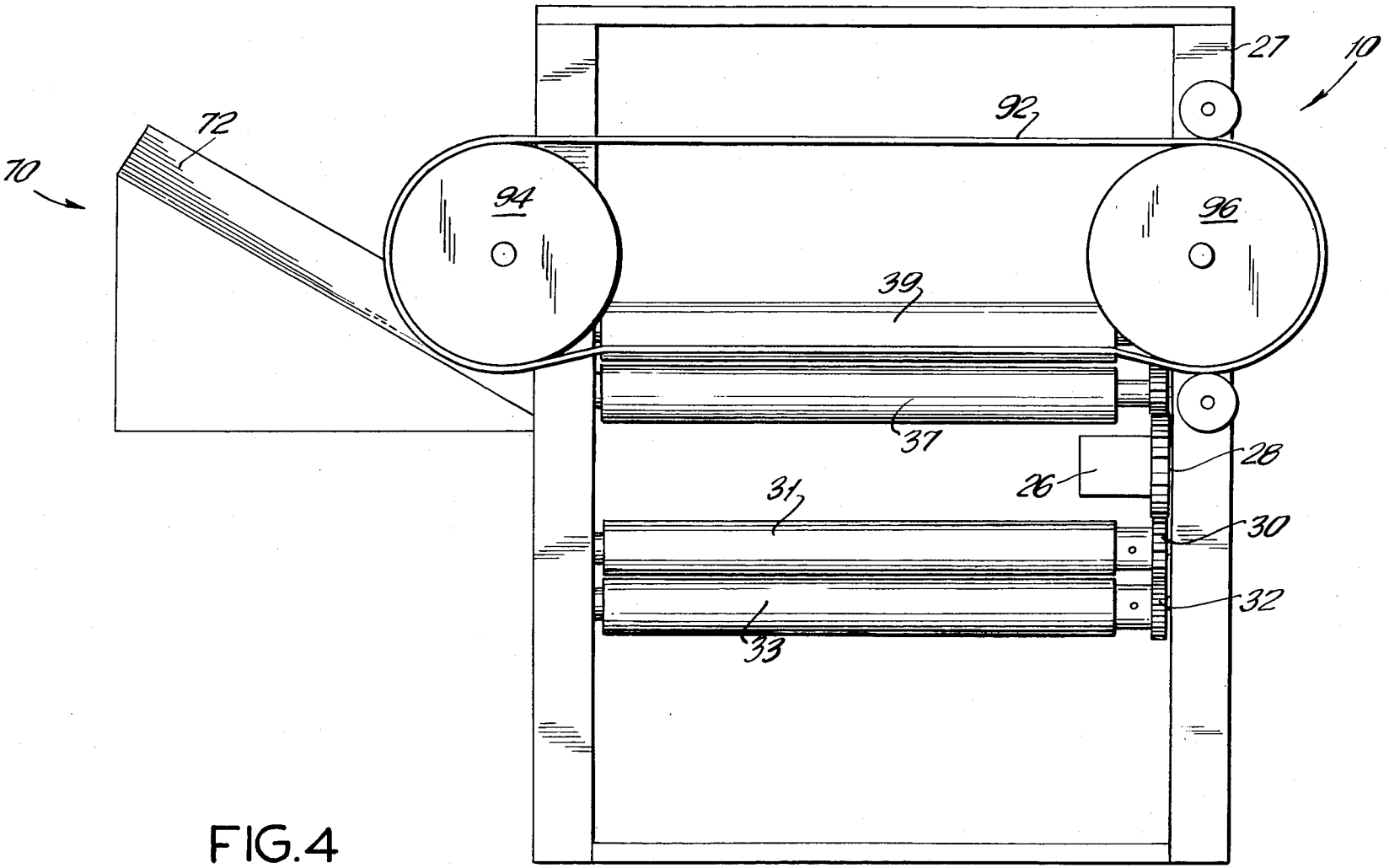
FIG. 4 is a front view of the inserting apparatus shown in FIG. 1.

The inserter 10 further includes an envelope feeder 70 which is operative to feed envelopes into a position to receive the folded sheet 14 and the card 64 as they are passed from the rollers 37 and 39. As shown more clearly in FIG. 4, the envelope inserter 70 includes a supply of envelopes 72 which are fed individually into position to receive the folded sheet 14 and card 64.

Figure 5:
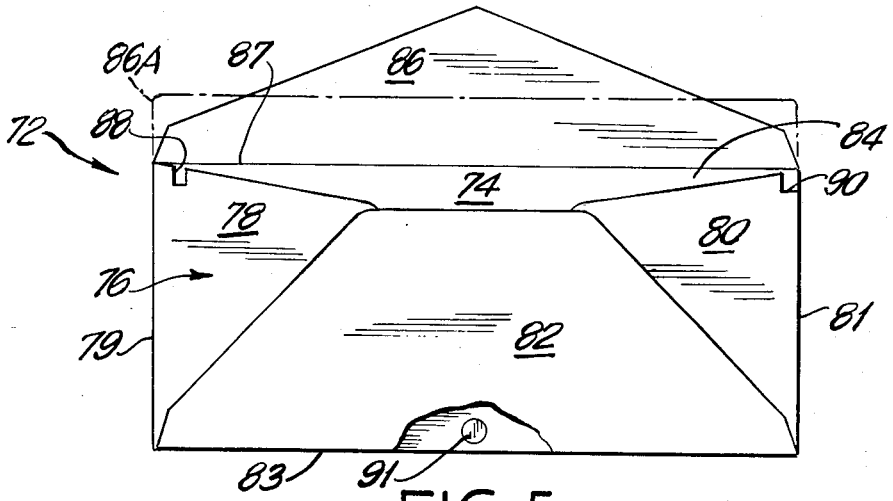
FIG. 5 is a plan view of the top of a form used with the inserter of the subject invention.

An envelope 72 preferred for use with the inserter 10 is illustrated in FIG. 5. More particularly, the envelope 52 includes a rectangular front face 74 and a rear face indicated generally by the numeral 76. The rear face 76 is formed by flaps 78, 80 and 82 which are articulated to the front face 74 along fold lines 79, 81 and 83 respectively. The flaps 78, 80 and 82 are folded into overlapping relationship to define an opening 84 in envelope 72. The envelope 72 further includes a flap 86 articulated to the front face 54 along fold line 87. As illustrated in FIG. 5, the flap 86 is of generally triangular shape in accordance with the standard construction of most envelopes. However, a rectangular flap 86A, as indicated in broken lines, may also be used. The flaps 78 and 80 are provided with slits 88 and 90 which are disposed generally in proximity to the respective fold lines 79 and 81. Slit 90 is illustrated as being immediately adjacent to the fold line 81. Although this location of slit 90 is functionally desirable, it may be considered to detract from the security of envelope 72 in that the flap 86 may not entirely cover the slit 90. Therefore, as an alternative to the location of slot 90, slot 88 is shown as being slightly spaced from its corresponding fold line 79. Typically, an envelope 72 would have its respective slits 88 and 90 symmetrically disposed relative to the fold lines 79 and 81 such that both slits 88 and 90 will either be immediately adjacent the corresponding fold lines 79 and 81 or both will be slightly spaced therefrom. The envelope 72 further includes a spot of metallic ink 91 or other metallic material on the front face thereof and spaced slightly from fold line 83. As explained below, the metallic ink 91 will enable accurate control of the inserter 10. A strip of metallic material, such as tape, may also be used. The meallic material may be an edge of the glassine address window.

Returning to FIG. 4, the envelopes 72 are fed serially by frictional interaction with the belt 92 which is driven by motor 93 through wheels 94 and 96. Preferably, the envelopes 72 are fed such that the rear face 76 thereof is disposed upwardly and in contact with the belt 92. Inserter 10 includes a pair of guides 98 and 100 which extend generally parallel to rollers 37 and 39 and slightly on opposite sides of the nip therebetween. The guides 98 and 100 also converge slightly toward one another at their respective opposed ends. The guides 98 and 100 further are disposed relative to the envelope feeder 70 to be substantially in line with the opening 84 in each envelope 72 ejected therefrom. Thus, as the envelopes 72 are moved by the belt 92, the flap 86 thereof will contact the converging portion of guide 100 and be urged away from the rear face 96 as the envelope 72 is moved relative to guide 100. This will cause a slight opening in the envelope 72. More particularly, the flap 86 and a portion of the front face 74 will be urged away from the rear face 86 by virture of the slits 88 and 90. The rear face 76 will further be urged away from the front face 74 as the rear face 76 is moved into contact with the guide 98. The slits 88 and 90 will enable a bending of the rear face 76 for easily accepting the material to be inserted therein.

The motor 93 which drives the wheel 94 is operative to start and stop intermittently. More particularly, the motor 93 is operative to stop after the envelope 72 has been fed into a proper position to receive a sheet 14. The motor will subsequently start to eject the properly inserted envelope 72 and to feed the next envelope into proper position to receive another insert. The proper timing of this intermittent action is achieved by a metallic sensor 102 which is mounted to the inserter 10 and is operative to detect the metallic ink 91 of envelope 72. More particularly, the metallic sensor 102 is in a position where it senses the metallic ink 91 when the envelope 72 is in a position to receive a folded sheet 14 and card 64. The rollers 37 and 39 will direct the combined sheet 14 and card 64 into the waiting envelope 72. Upon full insertion, the sheet 14 and card 64 will cover the metallic ink 91, thereby preventing receipt of a signal by the metallic sensor 102. The failure of the sensor 102 to sense the metallic ink 91 will cause the motor 93 to start again. Preferably, the motor 93 is operatively connected to the control means 20 such that the motor 93 will stop when the first and second feeders 11 and 12 have stopped. Similarly, the control means 20 will insure that the first and second feeders 11 and 12 are stopped when the supply of envelopes 72 is exhausted.

Alternatives to the metallic sensor 102 may also be employed. For example the inserter 10 may include light sensors and sources to control the movement of the envelope 72. A first light source 200 and sensor 201 may be positioned to indicate proper alignment of the envelope 72, thus stopping further movement of the envelope. A second light source 202 may have sufficient intensity to shine through the empty envelope 72 and to be received by the second sensor 203. However, the presence of the inserts in envelope 72 will block the light from the second source 202. This interruption in the signal received by the second sensor 203 will cause the motor 93 to start again, thereby ejecting the envelope 72 with the inserts and feeding the next empty envelope.

As explained previously, the inserter 10 is especially effective for coordinating the insertion of a plastic credit or identification card 64 and a corresponding sheet of material 14, such as a letter, into an envelope 72. Additionally, as explained previously, collating errors had been a particularly serious and prevalent error in prior art systems for mailing plastic credit or identification cards with an accompanying letter. To protect against these problems, the subject inserter is provided with several fail-safe checks. Specifically, the two types of collating errors that could occur are the inclusion of two cards with a single sheet and the inclusion of no card with a sheet. It will be appreciated that these two problems could occur substantially sequentially and would go undetected by the prior art spot checks.

One fail-safe system incorporated into the subject inserter 10 comprises a pressure sensitive switch 104 disposed substantially in line with the nip between rollers 37 and 39 and operatively connected to the control means 20. The pressure sensitive switch 104 is adjustably mounted to detect an insert having a thickness greater than the predetermined thickness for a folded sheet 14 plus one card 64. If a thickness greater than the predetermined amount is sensed by the pressure sensitive switch 104, an appropriate signal will be sent to the control means 20 to stop the operation of the first and second feeders 11 and 12 and the envelope feeder 70. A specific embodiment of the pressure sensitive switch 104 may include a spring loaded ball bearing which is biased a controlled amount toward the surface of the insert passing from the nip between rollers 37 and 39. An insert having a thickness greater than the predetermined amount will cause the ball bearing of the pressure sensitive switch 104 to be biased into a position for completing an electric circuit that will send an appropriate signal to the control means 20.

Another fail-safe system comprises the magnetic switch 58 incorporated into the guide assembly 50 which detects jams or the presence of too many sheets 14 being advanced simultaneously through the inserter 10.

Still another fail-safe system comprises the metallic sensor 102 described above. If no material is placed in the envelope 72 or if only the sheet 14 or only a card 64 is inserted, the sensor 102 will continue to sense the presence of metallic ink 91. Thus the controller 20 will stop all operations.

Figure 6:
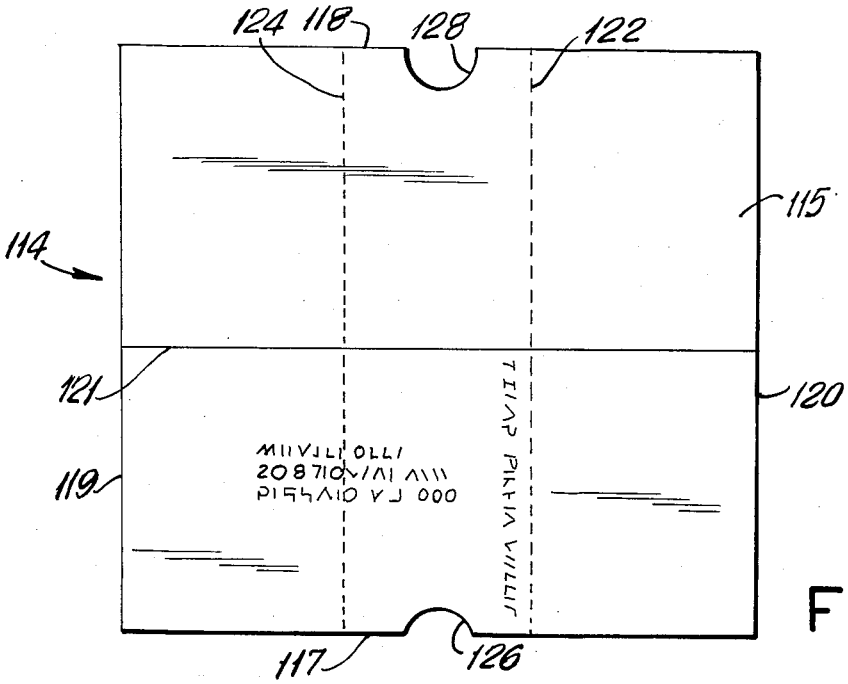
FIG. 6 is a plan view of the bottom side of the form shown in FIG. 5.
Figure 7:
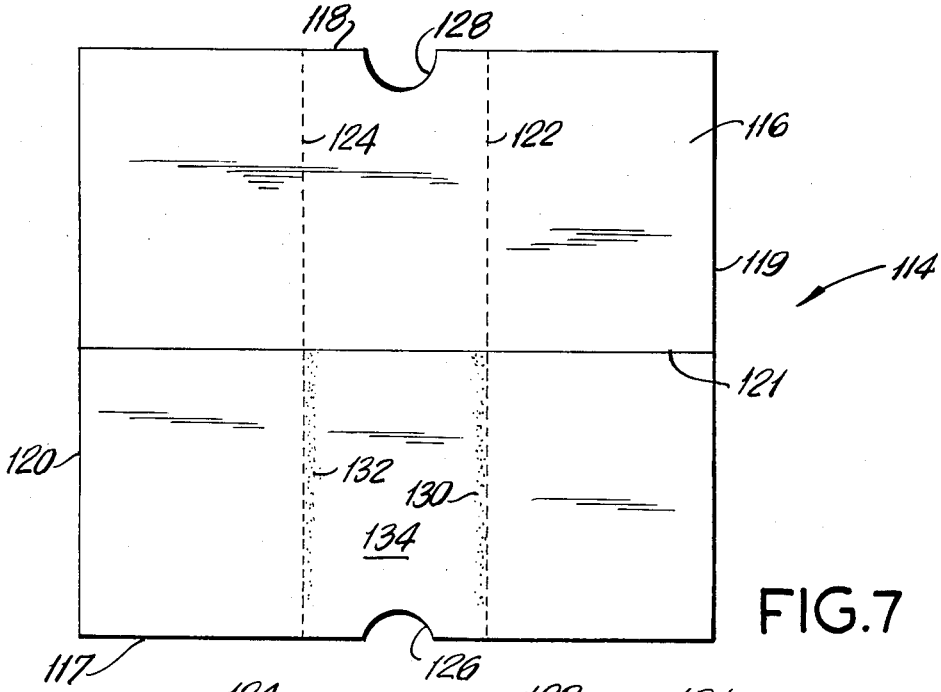
FIG. 7 is a top plan view of the form shown in FIGS. 5 and 6 folded and sealed and engaging a plastic card.
Figure 8:
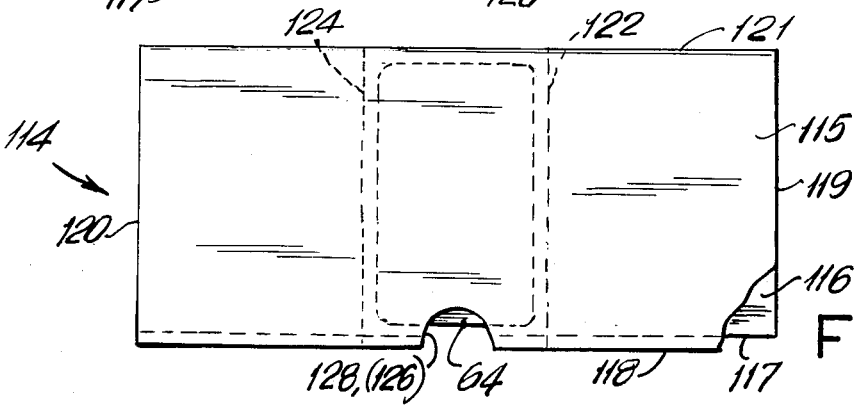
FIG. 8 is a top plan view of an envelope for use with the inserter of the subject invention.

A unique sheet 114, as shown in FIGS. 6–8, is particularly suited for use with the inserter 10 described above. Sheet 114 includes opposed sides 115 (FIG. 6) and 116 (FIG. 7). The sheet 114 is of generally rectangular shape and is defined by opposed leading and trailing parallel edges 117 and 118 and a pair of opposed parallel side edges 119 and 120. A score line 121 extends the entire distance between edges 119 and 120 and substantially parallel to edges 117 and 118 but approximately $\frac{1}{4}$ inch closer to edge 117. Perforation lines 122 and 124 extend substantially the entire distance between edges 117 and 118 and parallel to the edges 119 and 120. The spacing between perforation lines 122 and 124 and the location of perforation lines 122 and 124 relative to the edges 119 and 120 may vary depending upon the particular application. However, the spacing between perforation lines 122 and 124 should be sufficient to enable the placement of an appropriate plastic card therebetween. The sheet 114 further includes arcuate cut outs 126 and 128 which are disposed intermediate the perforation lines 122 and 124 and along edges 117 and 118 respectively.

With reference to FIG. 7, it is seen that adhesive areas 130 and 132 are disposed to define narrow strips adjacent perforation lines 122 and 124. The generally rectangular area 134 defined between score line 121 and the adhesive strips 130 and 132 is dimensioned to be slightly larger than a card 64 to be used with the form 114.

Returning to FIG. 1, the form 114 will be printed in the first feeder 11 with appropriate indicia such as the name, address, identification number corresponding to an individual for whom a card 64 is being manufactured in the second feeder 12. After proper printing in the first feeder 11, the sheet 114 is ejected therefrom in the manner described above. More particularly, the sheet 114 will be oriented such that edge 117 defines the leading edge and such that the surface 116 will be contacted by the card 64 printed in and ejected from the second feeder 12. As sheet 114 advances through inserter 10, applicators 62 will activate the adhesive strips 130 and 132. Furthermore, the first and second feeders 11 and 12 will be aligned relative to one another such that the card 64 will be ejected substantially into the area intermediate adhesive strips 130 and 132. As a result of this orientation, the card 64 ejected by the second feeder 12 will contact the form 114 substantially at the score line 121 and intermediate the area defined by adhesive strips 130 and 132. As the sheet 114 and the card 64 are drawn into the nip between rollers 37 and 39, the leading edge of the card 64 will remain substantially in contact with the score line 121 while the trailing edge will be adjacent the cut outs 126 and 128 for easy removal. The sheet 114 may be severed along perforation lines 122 and 124 to define a convenient storage case for card 64. The off-center position of fold line 121 causes edges 117 and 118 to be out of register, thereby facilitating the re-insertion of card 64.

As noted previously, an important objective of the subject invention is to provide an inserter that is sufficiently versatile for use in a small office that can only justify purchasing one inserter to perform several different functions. As an example, it may be desirable to insert sheets of material 14 into an envelope 72 without a card, return envelope or return postcard such as card 64. In these situations, the second feeder 12 either would not be present at all or would be temporarily out of use. As a result, the card 64 would not be present to urge the sheet 14 into the nip between rollers 37 and 39. To insure the proper grasping of each sheet 14 by the nip between rollers 37 and 39, the hinged guide assembly 50 is mounted in inserter 10 such that the hinge 156 is spaced from rollers 31 and 35 by a distance slightly less than the length of each sheet 14 being processed by the inserter 10. As a result, each sheet 14 will be urged into hinge 156 by the rollers 31 and 35. A continued movement of the sheet 14 by rollers 31 and 35 will require the sheet 14 to buckle somewhere along its length. This buckling is precisely controlled by the panel 48, and guides 52 and 54 such that the sheet 14 is buckled into the nip of rollers 37 and 39. With this embodiment of the invention, an insert 14, such as an invoice, may be inserted into an envelope 72 without a corresponding card 64 to initiate the folding of the sheet 14.

Figure 9:
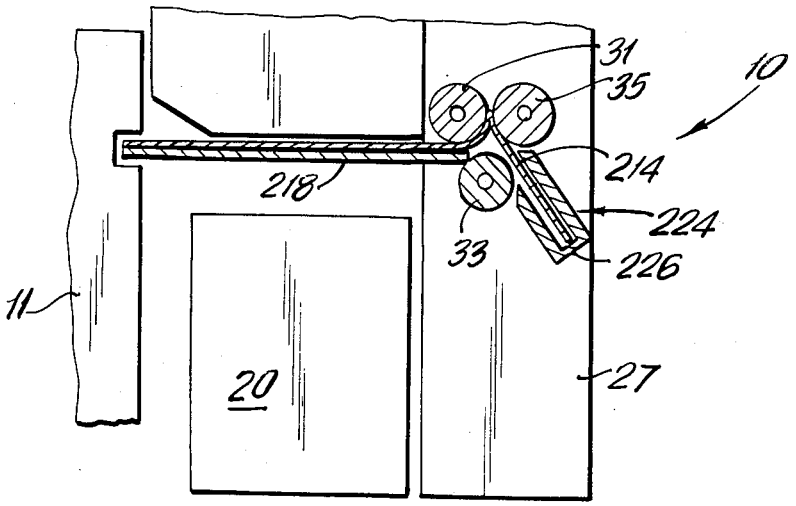
FIG. 9 is a side elevational view of the inserter of the subject invention in an alternate operating mode.

In many situations, it may be desirable for the inserter 10 to accommodate a standard sized 8½ inch by 11 inch sheet of paper 214 produced by the first feeder 11. This standard sized sheet 214 must be folded two times to fit into the standard envelope. To accomplish this double folding, a planar support 218 is used without upwardly curved guides as shown in FIG. 9. The inserter 10 shown in FIG. 9 is adapted with guide 224 which causes the leading edge 217 of each sheet 214 to be guided downwardly after passing through the rollers 31 and 33. The leading edge 217 thus will not enter the nip between rollers 31 and 35. The guide 224 includes a stop 226 which is mounted to frame 27 at a distance from the nip between rollers 31 and 33 less than one-third the length of sheet 214. When the sheet 214 contacts the stop 226, the sheet 214 will buckle upwardly at location approximately one-third along its length. The guide 224 carefully channelizes this buckling into the nip between rollers 31 and 35 such that a first fold is formed in the sheet 214. The sheet 214 then proceeds as had been described previously with respect to the FIG. 1 embodiment. More particularly, the sheet 214 will advance in a generally straight direction and will be urged into the nip between rollers 37 and 39 either by a card 64 ejected from the second feeder 12 or by a controlled buckling caused by the hinge 56. In either event, the sheet 214 will be urged into the nip between rollers 37 and 39 to form a fold line approximately two-thirds the distance from its leading edge 217. The folded sheet 214 will then be completely inserted into the envelope 62 as had been explained previously.

In summary, an inserting apparatus is provided for use with one or more feeders. The inserter will receive sheets of material sequentially and will fold each sheet and urge each sheet toward an awaiting envelope. This folding may be coordinated with and facilitated by the matching of a second insert or card with the first insert. The envelopes will be fed into a position to receive the one or more inserts and will be opened gradually as they are advanced into the receiving position. To facilitate this opening, each envelope preferably includes a pair of slits. The operations of the feeders and the inserter preferably are coordinated by a control means. The inserter may be provided with fail-safe means to detect jams, multiple feeds and to assure complete insertion into the envelope. Sheets are provided to securely engage a card and to function as a carrying case.

While the invention has been described relative to certain preferred embodiments, it is clear that various modifications thereto may be provided without departing from the scope of the invention as defined by the appended claims.

What is claimed is:

1. An inserting apparatus, comprising:

a first feeder means for sequentially feeding first sheets of material therefrom, each said first sheet having opposed first and second sides and opposed leading and trailing edges;

guide means for channelizing said first sheet along a predetermined path;

a pair of insert rollers disposed in spaced parallel relationship to one another and substantially adjacent said first side of said first sheet at a selected location along said path, said insert rollers being rotatably driven in opposite directions to define a nip therebetween;

second feeder means disposed substantially in line with the nip of the insert rollers but being substantially adjacent the second side of said first sheet, said second feeder means being operative to feed second sheets of material into contact with the first sheet at a selected location intermediate the leading and trailing edges thereof, and further being operative to urge both the first and second sheets into the nip between said insert rollers;

third feeder means for feeding envelopes having metallic material at a selected location thereon, said third feeder means being disposed to feed envelopes into a position in alignment with the nip between the insert rollers and on a side thereof opposite the second feeder, such that the first and second inserts urged through the nip between said insert rollers are urged by the insert rollers into an envelope from said third feeder means;

control means operatively connected to said first, second and third feeder means to coordinate the feeding operations thereof; and sensing means for sensing the presence of an envelope in a position to receive said first and second sheets of material, said sensing means being in communication with said control means and said third feeder means such that said third feeder means stops after one said envelope is sensed as being in a position to receive said first and second inserts, said sensing means being operative to sense the presence of said metallic material, the respective locations of said sensing means on said apparatus and said metallic material on said envelope being selected such that the metallic material is sensed substantially when the envelope is in position to receive the first and second sheets of material, the sensitivity of said sensing means being such that the metallic material will not be sensed when the first and second sheets of material are inserted between the metallic material and the sensing means, whereby upon complete insertion, as sensed by the sensing means, the third feeder commences operation again.

2. An apparatus as in claim 1 further comprising means for detecting multiple feeds of said first sheets of material.

3. An apparatus as in claim 2 wherein said guide means comprises a hinged guide plate rotatably mounted to said apparatus and wherein said means for detecting multiple insertions of said first sheets of material comprises a switch means adjacent said hinged guide plate, said switch means being operatively connected to said control means, said hinged guide plate and said switch means being disposed relative to one another such that a multiple feed of said first sheets of material causes said hinged guide plate to rotate relative to said switch means, whereby the rotation of said hinged guide plate relative to said switch means generates a signal for indicating a multiple feed.

4. An apparatus as in claim 1 further comprising means for sensing multiple feeds of said second inserts.

5. a first feeder means for sequentially feeding first sheets of material therefrom, each said first sheet having opposed first and second sides and opposed leading and trailing edges;

guide means for channelizing said first sheet along a predetermined path;

a pair of insert rollers disposed in spaced parallel relationship to one another and substantially adjacent said first side of said first sheet at a selected location along said path, said insert rollers being rotatably driven in opposite directions to define a nip therebetween;

second feeder means disposed substantially in line with the nip of the insert rollers but being substantially adjacent the second side of said first sheet, said second feeder means being operative to feed second sheets of material into contact with the first sheet at a selected location intermediate the leading and trailing edges thereof, and further being operative to urge both the first and second sheets into the nip between said insert rollers;

third feeder means for feeding envelopes into a position in alignment with the nip between the insert rollers and on a side thereof opposite the second feeder, such that the first and second sheets urged through the nip between said insert rollers are urged by the insert rollers into an envelope from said third feeder means;

control means operatively connected to said first, second and third feeder means to coordinate the feeding operations thereof; and a plurality of pairs of light sources and light sensors operatively connected to said control means and mounted adjacent said third feeder means such that the light source in each said pair is on one side of an envelope fed by said third feeder means and such that the light sensor in said pair is on the opposite side of said envelope, one said pair being disposed relative to said second and third feeder means to sense the presence of an envelope in a position to receive said sheets, a second of said pairs disposed in line with the nip of said rollers and having a light sensor with a sensitivity to sense light from said light source when the envelope is empty, but not when said sheets are disposed therein, whereby the control means stops the feeding operation of said third feeder means upon the interruption of the light sensed by the light sensor of the first of said pairs and starts the feeding operation of said third feeder upon the interruption of light sensed by the light sensor in the second pair.

6. An inserting apparatus comprising:

insert feeder means for sequentially feeding at least one sheet of material therefrom;

envelope feeding means for sequentially feeding envelopes therefrom into a position to receive said at least one sheet of material from said insert feeder;

control means for coordinating the operation of said insert feeder and said envelope feeder; and a plurality of pairs of light sensors and light sources operatively connected to said control means and mounted adjacent to said envelope feeder such that said light source in each said pair is disposed on one side of an envelope positioned to receive said sheet of material and such that the light sensor in said pair is disposed on the opposite side of said envelope, a first of said pairs being disposed relative to the insert feeder means and envelope feeder means to sense the presence of an envelope in a position to receive said sheet of material, a second of said pairs being disposed in line with the insert feeder means and having a light sensor having a sensitivity to sense light from said light source when the envelope is empty but not when said sheet is disposed therein, whereby the control means stops the operation of said envelope feeder upon the interruption of the light sensed by the light sensor in said first pair, and starts the feeding operation of the envelope feeder upon the interruption of light sensed by the light sensor in the second pair.

7. An inserting apparatus comprising:

insert feeder means for sequentially feeding at least one sheet of material therefrom;

envelope feeding means for sequentially feeding envelopes therefrom into a position to receive said at least one sheet of material from said insert feeder, each said envelope having metallic ink at a selected location thereon;

control means for coordinating the operation of said insert feeder and said envelope feeder; and sensing means for sensing the presence of an envelope in a position to receive said at least one sheet of material, said sensing means being in communication with said control means and said envelope feeding means such that the envelope feeding means stops after one said envelope is sensed as being in a position to receive said at least one insert, said sensing means being operative to sense the presence of said metallic material, the respective locations of said sensing means on said apparatus and said metallic material on said envelope being selected such that the metallic material is sensed substantially when the envelope is in a position to receive said at least one sheet of material, the sensitivity of said sensing means being such that the metallic material will not be sensed when the at least one sheet of material is inserted between the metallic material and the sensing means, whereby upon complete insertion, as sensed by the sensing means, the envelope feeder commences operation again.

* * * * *